United States Patent [19]

Stanford

[11] Patent Number: 5,038,577

[45] Date of Patent: Aug. 13, 1991

[54] AIR INTAKE ARRANGEMENT FOR AIR CONDITIONER WITH DUAL CROSS FLOW BLOWERS

[75] Inventor: Robert G. Stanford, Murfreesboro, Tenn.

[73] Assignee: Inter-City Products Corporation (USA), LaVergne, Tenn.

[21] Appl. No.: 478,416

[22] Filed: Feb. 12, 1990

[51] Int. Cl.[5] ..... F25D 23/12; E06B 7/02

[52] U.S. Cl. ..... 62/262; 98/94.2

[58] Field of Search ..... 62/262; 98/94.2, 121.1

[56] References Cited

U.S. PATENT DOCUMENTS

| | | | |
|---|---|---|---|
| 2,804,758 | 9/1957 | Smith et al. | 62/262 X |
| 3,200,609 | 8/1965 | Laing | 62/280 |
| 3,301,003 | 1/1967 | Laing | 62/324.1 |
| 3,404,539 | 10/1968 | Laing | 62/262 |
| 3,762,303 | 10/1973 | Hoffman | 98/114 |
| 4,100,764 | 7/1978 | Murano | 62/289 |
| 4,111,000 | 9/1978 | Sakazume et al. | 62/262 |
| 4,367,636 | 1/1983 | Sakuma et al. | 62/262 |
| 4,478,053 | 10/1984 | Yano et al. | 62/262 |
| 4,733,542 | 3/1988 | Blair | 62/263 |

FOREIGN PATENT DOCUMENTS

| | | | |
|---|---|---|---|
| 0062530 | 4/1985 | Japan | 62/262 |

OTHER PUBLICATIONS

Publication: Investigation of the Flow Characteristics in the Impeller of the Tangential Fan, T. Lajos.

Publication: An Experimental Study of Cross Flow Fan, S. Murata and K. Nisnihar, AS-1973.

Publication: The Effect of Rotor and Casing Design on Cross-Flow Fan Performance, D. J. Allen, AT-1982.

*Primary Examiner*—William E. Wayner

*Attorney, Agent, or Firm*—Jeffers, Hoffman & Niewyk

[57] ABSTRACT

The present invention is an air conditioning unit with indoor and outdoor heat exchanger coils and a pair of dual tangential flow blowers. Air flow is induced through the coils at a uniform rate and exhausted through an outlet. A single scroll dividing wall divides the housing of the air conditioner into indoor and outdoor compartments. The air-conditioning unit has a relatively small depth because the blowers are positioned in vertical alignment. The air intake arrangement on the indoor side is an intended, recessed portion of the cabinet. A removable louvered cover is positioned in an aperture located in the indented, recessed portion for allowing access to the filter.

14 Claims, 2 Drawing Sheets

AIR INTAKE ARRANGEMENT FOR AIR CONDITIONER WITH DUAL CROSS FLOW BLOWERS

BACKGROUND OF THE INVENTION

This invention relates to air conditioners and heat pumps and in particular to self contained packaged air conditioner and heat pump units which include both indoor and outdoor coils and a pair of blowers.

Conventional packaged air conditioners and heat pumps generally include both a conventional centrifugal blower for the indoor heat exchanger and an axial blower for the outdoor heat exchanger. All conventional packaged terminal air conditioners also include some type of dividing wall which divides the indoor portion of the unit from the outdoor portion of the unit. Air is conventionally drawn into the unit through the sides, the rear, the outside face, or the bottom of the unit and is blown out of the unit after passing over the heat exchangers.

Some prior art air conditioners have included tangential or cross flow blowers for the indoor heat exchanger. U.S. Pat. No. 4,478,053 discloses an air conditioner which includes two vertically mounted cross flow blowers, one of which is used to move air across the indoor heat exchanger and the other which is used to move air across the outdoor heat exchanger. This patent shows a dividing wall for separating the two blowers comprising a complicated hollow double walled structure to permit ventilation. Separate rounded parts provide scrolls for the blowers. Other prior art air conditioners have used centrifugal or axial flow blowers.

Several problems have been encountered with the prior art air conditioners with axial flow fans and centrifugal blowers described above. One of the problems is that the air flow through or across the heat exchangers is non-uniform due to the nonuniform performance characteristics of prior art blowers whereby hot spots develop in the heat exchangers, thus causing the heat transfer process to be less efficient than desired.

Another problem with these prior art air conditioners has been that they are rather noisy. The noise is primarily created by the air flow through the unit because prior art centrifugal or axial flow blowers generate substantial expansion and contraction of the air and cause impact of the blower blades upon the air. Such noise is particularly undesirable as packaged air conditioners are commonly used in dwelling places, either by mounting through a wall or in a window.

Another problem with prior art self contained air conditioners has been that, due to the types of blowers used, the depth dimension of the unit is much greater than is desired. Thus the prior art units tend to take up much more space in the dwelling than is desired.

U.S. Patent Nos. 3,200,609 (Laing) and 3,301,003 (Laing) disclose air conditioners which use two cross flow blowers. Both of these patents disclose air conditioners with various arrangements of the evaporator and condenser coils and of the cross flow blowers. Each side of the air conditioner has a heat exchanger coil in communication with the indoor or outdoor air, respectively. Cross-flow blowers are positioned in respective interior regions for inducing air flow through approximately half of the heat exchanger and for forcibly blowing air through the other half of the heat exchanger. The respective interior regions are located on opposite sides of a divider wall which includes additional curved wall portions for guiding the flow of air away from the respective cross-flow blower. The air conditioner design of Laing reduces the width of the air conditioner by positioning the cross-flow blowers in a vertical stacked arrangement. However, many problems exist with the air conditioner of Laing.

One problem with the Laing air conditioner relates to its air intake arrangement. A grill covers the intake section of the heat exchanger. Visually, a grill covering is much less attractive than a solid panel. Functionally, such a large grill is more likely to take air in which was exhausted from the air conditioner thereby setting up a closed loop of air flow. Further, a grill only partially protects the interior contents of the air conditioner. In addition, to hold the grill against the filter in the Laing air conditioner, an extra apertured backing is provided, and the grill pivots to allow access to the filter. However, providing a structurally sound pivot increases the cost of the air conditioner.

An additional problem with the Laing air conditioner involves the air flow. Each blower induces air flow through one section of its heat exchanger and forces air out a second section of its heat exchanger. This creates a first induced air stream which is at a different temperature than a second forced air stream. However, the same heat exchanger interacts with both air streams, so that the heat exchange is less efficient than in a structure wherein all the air passing through the heat exchanger is at the same temperature. A further inefficiency caused by the air streams is that the fan discharge air stream has a non-uniform velocity which can cause hot spots, and ameliorating this problem requires that additional flow channeling cowlings be positioned between the blower and the heat exchanger and requiring the fan to operate at a higher RPM. This higher RPM can cause further noise.

Still another problem with the air conditioner of Laing involves the number of dividing wall pieces required to form the indoor and outdoor compartments of the air conditioner. One partition wall is needed to separate the indoor compartment from the outdoor compartment, and each compartment requires additional wall structures, including one guide wall and one curved portion. Additional pieces would also be required for causing a more uniform flow of blown air through the heat exchanger as mentioned above. The numerous additional parts increase the difficulty of assembly, and each additional part creates a possibility of noise generation by a loose or degenerated attachment.

A further problem with the air conditioner shown in Laing is an unsatisfactory handling arrangement for condensate. Condensate is collected in the sump and from there is picked up by a fibrous belt to be carried to the top of the air conditioner. The condensate water drops onto the blades of the blower rotor so that the water is broken up into tiny droplets which are then carried off in the warm air stream passing from the blower to the heat exchanger. While this arrangement is satisfactory when the air conditioner is used in the cooling mode, in the heating mode an arrangement must be provided to prevent condensate from the outdoor coil from being returned to the outdoor coils where it could freeze and reduce the capacity of the unit. In some prior art air conditioners, a drain valve has been provided which normally opens in cold weather to allow the condensate to drain off so that the condensate does not get thrown back onto the cold coil.

A further problem of the prior art air conditioners has been that they have used a substantial number of parts in order to provide the indoor and outdoor compartments and the blower scrolls, thereby adding expense to such units. A conventional design of a packaged air conditioner with a centrifugal indoor blower and a axial outdoor fan has seven basic components, namely a blower scroll, blower orifice, blower discharge deck, divider wall, divider wall cover, condenser fan orifice, and condenser fan shroud. Considering that each basic component requires additional parts and fasteners, the assembly of a package air conditioner can become quite time consuming and costly.

It is therefore desired to provide a self contained packaged air conditioning unit wherein the air intake arrangement is visually and functionally pleasing, wherein the filter can easily be accessed with minimum cost, wherein the entering and exiting air flows are separated, wherein the flow of air through or across the heat exchangers is uniform, wherein the speed of the air flow through the unit is relatively low thereby causing the unit to be quiet, wherein the depth dimension of the unit is much less than in conventional units, wherein the blowers are driven more reliably and efficiently, and wherein the number of parts used in constructing the unit is much smaller than in conventional units.

SUMMARY OF THE INVENTION

The present invention, in one form, thereof, overcomes the disadvantages of the above described prior art air conditioners by providing an improved air conditioner therefor. The air conditioner according to the present invention includes dual cross flow or tangential blowers which are horizontally mounted. The blowers are divided by a single unitary scroll dividing wall which is constructed so that it wraps partially around the cross flow blowers to thereby guide the flow of air through the blowers. By means of this arrangement the blowers can be mounted with their axis separated by only a small horizontal distance, so that the depth dimension of the air conditioner is kept to a minimum.

The present invention, in one form thereof, comprises an air conditioner including a housing, an indoor heat exchanger and tangential blower, an outdoor heat exchanger and tangential blower, and a cabinet. The housing has indoor and outdoor compartments, and includes a bottom and an indoor inlet. The indoor heat exchanger and tangential blower are located in the indoor compartment; similarly, the outdoor heat exchanger and tangential blower are located in the outdoor compartment. The cabinet extends over the housing and includes an aperture adjacently located with the indoor inlet. The aperture is defined by an indented recessed portion of the cabinet which is located adjacent to the indoor inlet and the housing bottom.

The air intake arrangement of the present invention allows the air conditioner to be located at the floor level, yet the majority of the indoor portion of the cabinet has a smooth, generally vertical planar surface. The exhaust of the air conditioner flows through an outlet above the vertical surface; and the vertical surface is above an inlet located proximate an indented, recessed portion of the cabinet. This arrangement provides conditioned air at a height desired by the occupants, separates the intake and exhaust flows so that the same air is not recirculated, and hides the air intake from the occupants.

The present invention, in another form thereof, comprises an air conditioner including a housing, an indoor heat exchanger and tangential blower, an outdoor heat exchanger and tangential blower, a filter, and a cabinet with a removable louvered cover. The housing has indoor and outdoor compartments, and includes an indoor inlet and a bottom. The indoor heat exchanger and tangential blower are located in the indoor compartment; similarly, the outdoor heat exchanger and outdoor tangential blower are located in the outdoor compartment. The filter is adjacent the indoor heat exchanger. The cabinet extends over the housing and includes an aperture adjacent to the indoor inlet. The removable louvered cover is connected to the cabinet in the aperture and provides access for removing or inserting the filter.

The present invention allows for rigid mounting of the indoor portion of the cabinet because the filter can be accessed by removing the louvered cover. The louvered cover is snapped into place or held in place by screws and nuts, with the nuts being accessible through the gaps in the louvered cover. Assembly of the air conditioner is simple because the outdoor portion of the cabinet, called the sleeve, is attached to the chassis with screws. Secondly, the front panel of the cabinet is attached to the chassis with screws, Finally, the louvered cover can be secured to the indoor portion of the cabinet by a snap fit or by screws and nuts. Removal of the louvered cover is possible by pulling on the louver top to release the snaps or by unscrewing the attaching screws.

The appliance, constructed in accordance with the invention, has the advantage that it is much more quiet than conventional units because of the lower air velocity through the blowers and reduced spacing between the blower and the cut-off of the air conditioner. Furthermore, the induced air flow through the heat exchanger coils is much more uniform than in conventional units thereby causing substantially full utilization of the indoor and outdoor heat exchanger coils and providing greater efficiency of the appliance.

Another advantage of the invention is that the depth of the appliance can be much reduced because of the over/under blower mounting and configuration. Additionally, since air flow occurs only through the front and rear of the unit, coils with a greater width dimension may be used than could be used ir prior art units, whereby fewer rows of cooling coils need to be provided. This results in additional savings in the construction of the heat exchanger coils.

In addition, one blower is driven by a single motor and the other blower is drivingly connected by means of belts and pulleys to the one blower on the opposite side of the motor, thus resulting in additional savings.

A still further advantage of the instant invention is that the number of parts used in constructing the unit may be reduced substantially from conventional units, thereby generating further cost savings.

BRIEF DESCRIPTION OF THE DRAWINGS

The above mentioned and other features and objects of this invention and the manner of attaining them will be more apparent and the invention itself will be better understood by reference to the following description of an embodiment of the invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
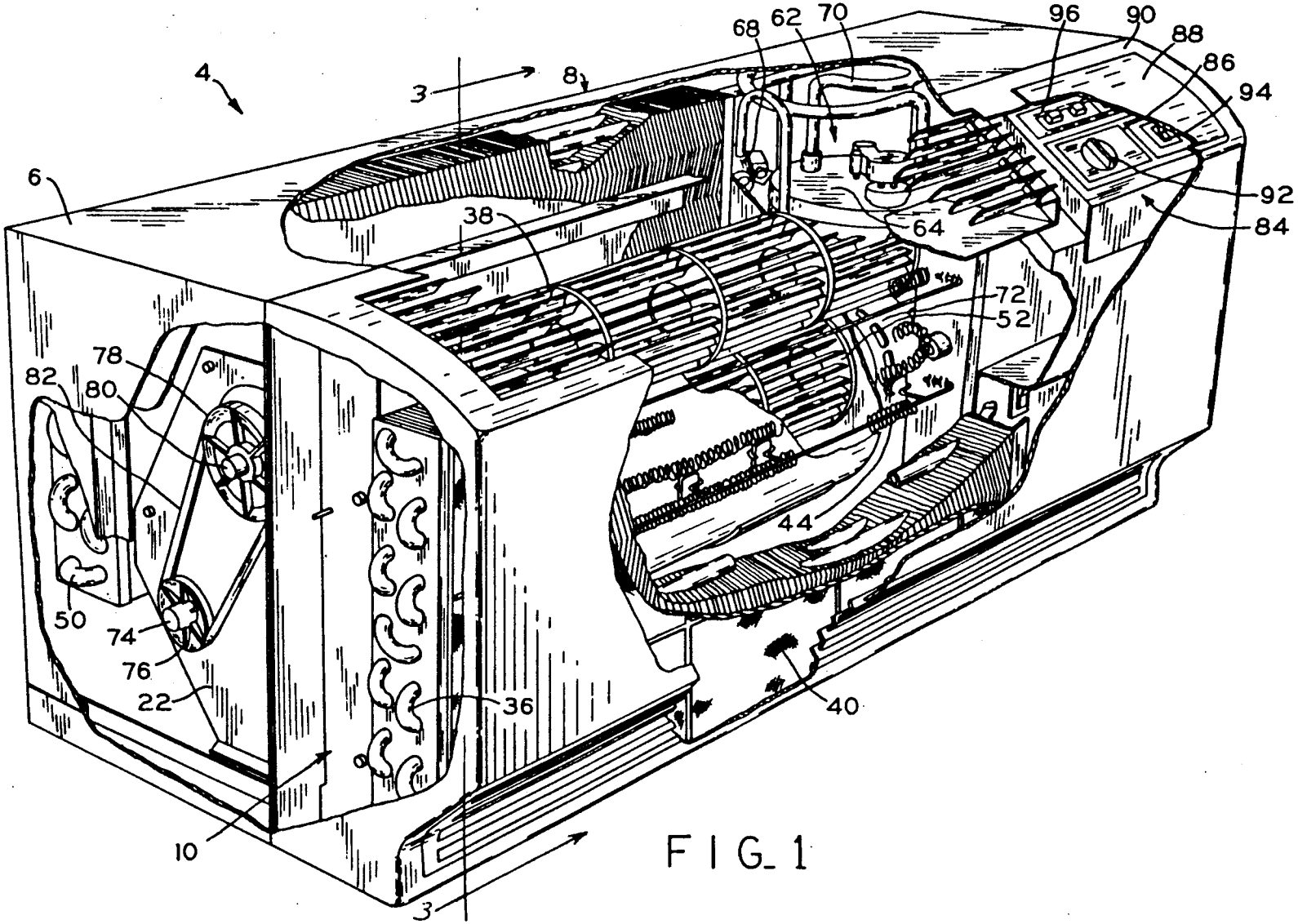
FIG. 1 is a perspective view in partial cross-section of an air conditioner according to the present invention.
Figure 2:
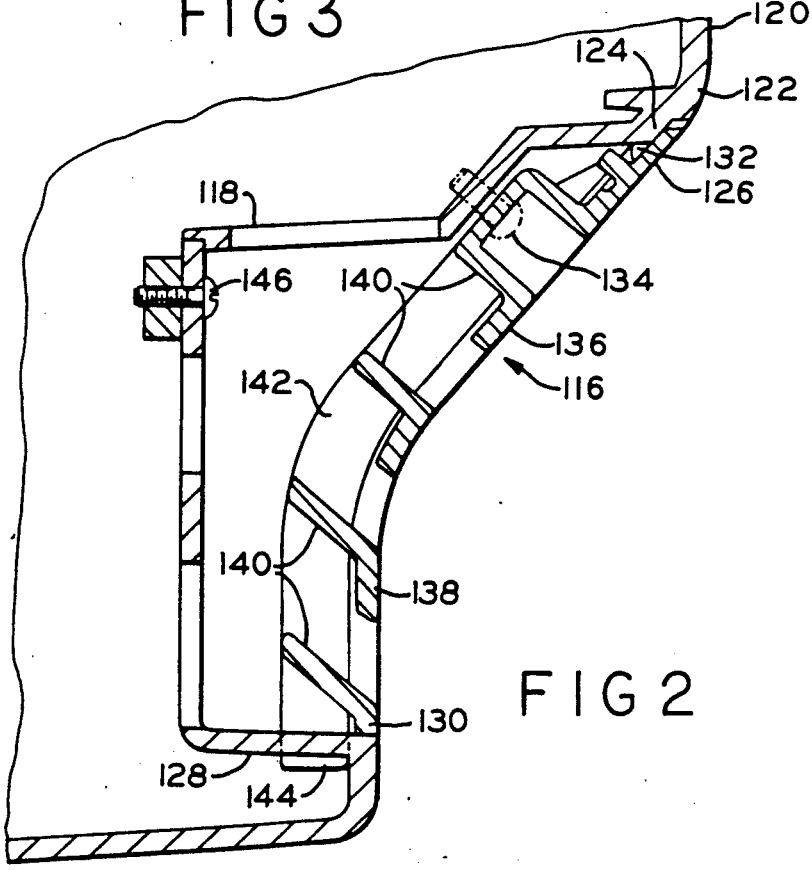
FIG. 2 is a partial enlarged cross sectional view of the air conditioner with the cabinet removed of outlined area 2 of FIG. 3.

The present invention is a packaged terminal air conditioner 4 shown in FIGS. 1 and 2. Further details of a packaged terminal air conditioner are disclosed in copending U.S. applications entitled AIR CONDITIONER WITH DUAL CROSS FLOW BLOWERS Ser. No. 478,342 and DRIVING SYSTEM FOR DUAL TANGENTIAL BLOWERS IN AN AIR CONDITIONER, Ser. No. 478,410, filed on even date herewith and assigned to the assignee of the present invention, which disclosure is incorporated herein by reference. Within cabinet 6, the air conditioner unit 8 has four basic elements: housing 10, indoor cut-off 12, outdoor cut-off 14, and divider wall 16. Housing 10 has a top wall 18, a basepan 20, and side walls 22. Indoor cut-off 12 partitions the front or indoor compartment 24 into an indoor inlet section 26 and an indoor outlet section 28. Outdoor cut-off 14 partitions the rear or outdoor compartment 30 into an outdoor inlet section 32 and an outdoor outlet section 34. Divider wall 16 separates indoor compartment 24 and outdoor compartment 30.

Figure 3:
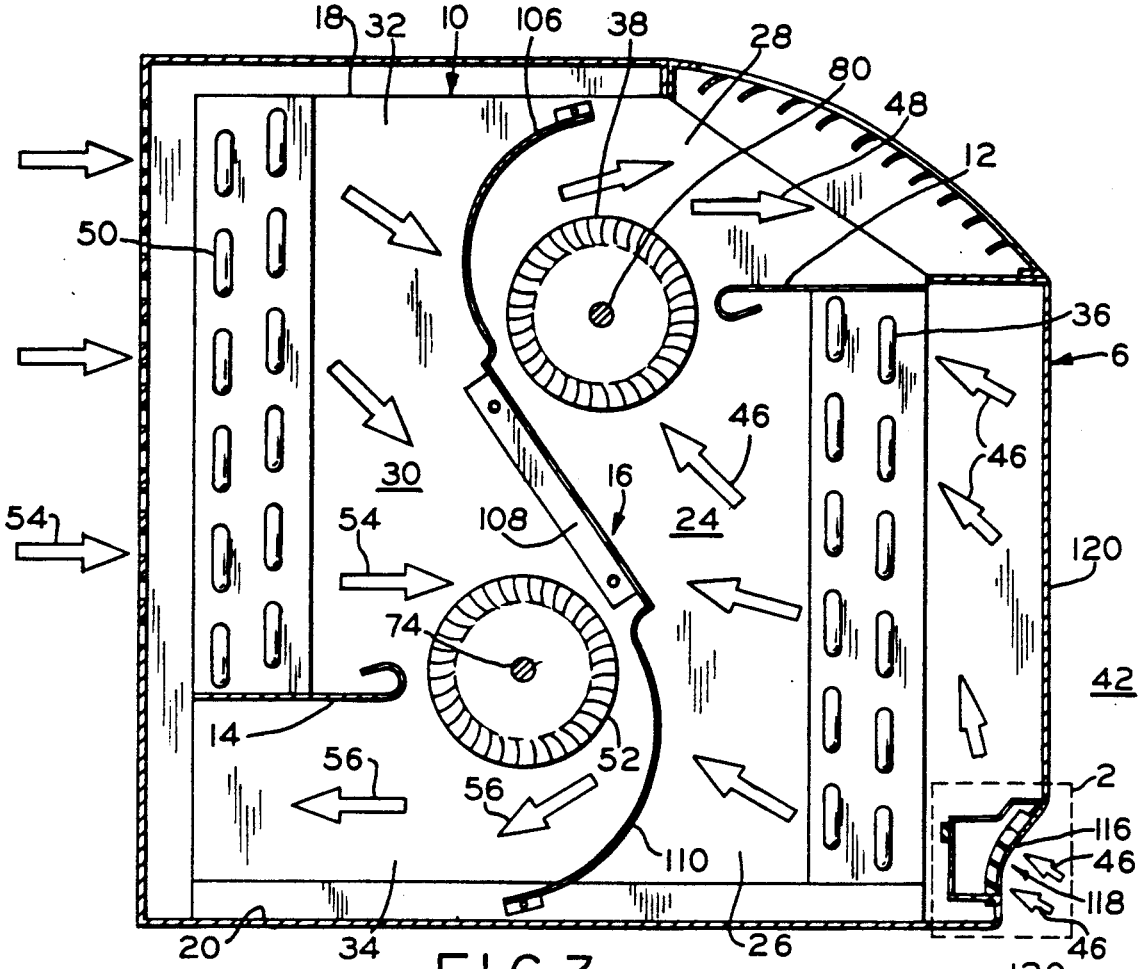
FIG. 3 is a sectional view of the air conditioner taken along line 3—3 of FIG. 1.

Indoor compartment 24 has a heat exchange coil 36 located within inlet 26, and has a tangential or cross flow blower 38 located upwardly therefrom between indoor cut-off 12 and divider wall 16 near outlet 28. Filter 40 is placed in front of indoor heat exchanger 36 for filtering the recirculated air. Filter 40 is removably mounted for cleaning, repair, and replacement. Electric heating wires 44 extend within indoor compartment 24 between side walls 22 intermediate indoor heat exchanger 36 and blower 38; heating wires 44 provide additional heat when the heat pump alone cannot provide enough heat. Blower 38 induces a lower air flow (see arrows 46 in FIG. 3) which passes over heat exchanger 36 and heating wires 44 and is then exhausted upwardly through outlet 28 (see arrows 48 in FIG. 3).

Outdoor compartment 30 also has a heat exchange coil 50 located within inlet 32, and has tangential or cross flow blower 52 located downwardly between outdoor cut-off 14 and divider wall 16 near outlet 34. Blower 52 induces an upper air flow (see arrows 54 in FIG. 3) which passes over heat exchanger 50 and is then downwardly exhausted through outlet 34 (see arrows 56 in FIG. 3).

The refrigeration components 62 are positioned within cabinet 6 on one side of air conditioning housing 10. Compressor 64, valve 68, and refrigerant lines 70 of components 62 operate in a known manner to appropriately heat or cool heat exchanger 36 for conditioning indoor air 42. Electric motor 72 is also located in the same general area of components 62, and drives both indoor blower 38 and outdoor blower 52.

Motor 72 is connected to axis 74 of driving blower 52, preferably by a resilient hub (not shown). On the opposite side, pulleys 76 and 78 are connected to axles 74 and 80 of driving and driven blowers 52 and 38, respectively. Belt 82 couples pulleys 76 and 78 so that the rotational movement imparted to driving blower 52 is transmitted to driven blower 38. Preferably, driving pulley 76 has a smaller circumference than driven pulley 78 to provide a slower and more comfortable exhaust air flow for the indoor occupants.

Heat pump 62 and motor 72 are electrically coupled to control unit 84. Control unit 84 is located on the same side of air conditioning housing 10 as components 62 and has a control panel 86 facing upwardly under control cover 88 of cabinet 6. Control cover 88, as well as the other parts of the top surface of indoor panel 90, has a sloping, curved upper surface which helps to prevent damage from the occupants placing heavy objects upon it. In the preferred embodiment, control panel 86 has a rotary switch 92 for variably selecting the temperature intensity, a fan speed switch 94 for selecting between two different fan speeds, and four mutually exclusive mode setting switches 96: cooling mode, heating mode, fan only mode, and off. Also included within unit 84, although not shown, is a temperature limiting device which can be set by the owner to prevent the air conditioner from operating outside a predetermined range of temperature settings.

Divider wall 16 is a single, unitary panel which separates the interior of housing 10 into indoor and outdoor compartments 24 and 30. The top of divider wall 16 forms a scroll portion 106 having an arcuate surface generally corresponding to the shape of blower 38 for guiding exhausted air towards indoor outlet 28. Middle portion 108 is disposed between blowers 38 and 52, and has a flat surface generally tangential to both. At the bottom of divider wall 16, a scroll portion 110 forms an arcuate surface generally corresponding to the shape of blower 52 for guiding exhausted air towards outdoor outlet 34. Thus, divider wall 16 is a unitary panel which serves as a scroll for both blowers 38 and 52, and additionally partitions housing 10 into indoor and outdoor compartments 24 and 30.

The air flow induced through compartments 24 and 30 provides superior performance of the unit as compared to forced-air systems because air flows 46 and 54 through heat exchangers 36 and 50, respectively, are more uniform thereby increasing the efficiency of the heat exchange. This allows for heat exchangers 36 and 50 to utilize a less expensive design which includes larger pipes with fewer rows and still provides adequate heating or cooling. The induced flow results from the structure and arrangement of blowers 38 and 52.

On opposite sides of divider wall 16, indoor blower 38 is positioned above outdoor blower 52. Axles 74 and 80 define a plane which is substantially vertically oriented. Because of the relative orientation of blowers 38 and 52, the depth of air conditioning unit 8 is minimized, and therefore the depth of the entire package terminal air conditioner 4 is correspondingly minimized.

In accordance with the present invention, cabinet 6 includes a louvered cover 116 within an indented, recessed portion 118 (see FIG. 2). At the bottom of vertical portion 120, corner 122 has an inturned flange 124 for mating with upper edge 126 of louvered cover 116. Front edge flange 128 of housing 10 extends upwardly for mating with lower edge 130. One portion of louvered cover 116 is secured to cabinet 6 by snap latch 132 engaging upper edge 126. Optionally, another portion of louvered cover 116 can be secured to cabinet 6 by two screws 134 engaging metal clip type fastening (not shown) through recessed portion 118.

Louvered cover 116 includes two generally planar portions 136 and 138 which intersect at an obtuse angle. Each portion 136 and 138 includes a plurality of separators 140 horizontally disposed across recessed portion 118 which intersects a plurality of vertical ribs 142 spaced equidistantly across louvered cover 116. Bottom portions 144 of ribs 142 hook into recessed portion 118.

In operation, air conditioning unit 8 is activated by mode switches 96. If fan only switch 102 is switched on, then only motor 72 is activated to rotate blower 52 according to a speed determined by fan speed switch 94. If cooling mode switch 98 is switched on, the compressor 64 begins to operate and valve 68 is positioned to cool indoor heat exchange 36, and motor 72 is activated to rotate blower 52 according to a speed determined by fan speed switch 94. If the heating mode switch 100 is on, then compressor 64 begins to operate and valve 68 is positioned to heat indoor heat exchanger 36 and motor 72 is activated to rotate blower 52 according to a speed determined by fan speed switch 94. Also in the heating mode, heating wires 44 may be actuated to produce additional heat and warm indoor air 42. In all of the modes except off 104, blowers 38 and 52 operate to induce air flow through inlets 26 and 32, the exhaust air through outlets 28 and 34.

The manufacture of packaged terminal air conditioner 4 is efficiently accomplished because of the bifurcated design. The air circulating portion is contained within housing 10, which can be assembled separately. Refrigeration components 62, associated motor 72, and control unit 84 can also be separately assembled on a frame (not shown). Cabinet 6 is separately fabricated, with louvered cover 116 adapted to snap fit into recessed portion 118. To complete an individual unit, housing 10 is attached to a frame, motor 72 is connected to axis 74, and refrigerant lines 70 are coupled to indoor heat exchanger 36 and outdoor heat exchanger 50; the process is completed by attaching the indoor and outdoor portions of the cabinet to their respective portions of the housing, including using one screw 146 at each end to attach cabinet 6 to housing 10 and then snapping louvered cover 116 into recessed portion 118.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. An air conditioner comprising:

a housing including an indoor compartment, an outdoor compartment, a bottom, and an indoor air inlet;

an indoor heat exchanger and an indoor tangential blower located in said indoor compartment;

an outdoor heat exchanger and an outdoor tangential blower located in said outdoor compartment; and a cabinet extending over said housing, said cabinet including a wall spaced from said indoor heat exchanger and defining a space therebetween, said cabinet further including an aperture adjacent said indoor inlet, said aperture defined by an indented recessed portion of said cabinet, said indoor heat exchanger substantially blocking communication between said aperture and said indoor tangential blower and said indented recessed portion located adjacent said indoor inlet and said housing bottom whereby air flowing into said inlet is guided through said space and said indoor heat exchanger and into said indoor tangential blower.

2. The air conditioner of claim 1 wherein an upper portion of said indented recessed portion includes a planar surface oriented at an angle relative to said wall.

3. The air conditioner of claim 1 wherein said indented recessed portion includes a plurality of slots for guiding air flow into said indoor compartment.

4. The air conditioner of claim 3 wherein said plurality of slots is disposed between a plurality of horizontal separators and a plurality of vertical column supports.

5. An air conditioner comprising:

a housing including an indoor compartment, an outdoor compartment, a bottom, and an indoor inlet;

an indoor heat exchanger and an indoor tangential blower located in said indoor compartment;

an indoor heat exchanger and an outdoor tangential blower located in said outdoor compartment;

a filter located adjacent said indoor heat exchanger; and a cabinet extending over said housing, said cabinet including a wall spaced from said indoor heat exchanger and defining a space therebetween, said cabinet further including an aperture adjacent said indoor inlet and said housing bottom whereby air flowing into said inlet is guided through said space and said indoor heat exchanger and into said indoor tangential blower;

said cabinet also including a removable louvered cover for covering said filter and indoor heat exchanger whereby access into said cabinet for removing or inserting said filter is provided when said louvered cover is removed.

6. The air conditioner of claim 5 wherein said louvered cover is secured to said cabinet by a snap fit.

7. The air conditioner of claim 5 wherein said louvered cover includes a plurality of slots for guiding air flow into said space.

8. The air conditioner of claim 7 wherein said plurality of slots is disposed between a plurality of horizontal separators and a plurality of vertical column supports.

9. An air conditioner comprising:

a housing including an indoor compartment, an outdoor compartment, a bottom, and an indoor inlet;

an indoor heat exchanger and an indoor tangential blower located in said indoor compartment;

an outdoor heat exchanger and an outdoor tangential blower located in said outdoor compartment; and a cabinet extending over said housing, said cabinet including a wall spaced form said indoor heat exchanger and defining a space therebetween, said cabinet further including an aperture adjacent said indoor inlet, said aperture defined by an indented recessed portion of said cabinet, said indoor heat exchanger substantially blocking communication between said aperture and said indoor tangential blower and said indented recessed portion located adjacent said indoor inlet and said housing bottom whereby air flowing into said inlet is guided through said space and said indoor heat exchanger and into said indoor tangential blower;

said cabinet also including a removable louvered cover for covering said indoor heat exchanger.

10. The air conditioner of claim 9 wherein said louvered cover is located within said indented recessed portion.

11. The air conditioner of claim 9 further comprising a filter adjacent said indoor heat exchanger.

12. The air conditioner of claim 9 wherein said louvered cover includes a plurality of slots for guiding air flow into said space.

13. The air conditioner of claim 12 wherein said slots are disposed between a plurality of horizontal separators and a plurality of vertical column supports.

14. The air conditioner of claim 9 wherein said louvered cover is secured to said cabinet by a snap fit.

* * * * *